US008240221B2

(12) United States Patent
Simpson et al.

(10) Patent No.: US 8,240,221 B2
(45) Date of Patent: Aug. 14, 2012

(54) BEAM PUMPING UNIT FOR INCLINED WELLHEAD

(75) Inventors: Roddy W. Simpson, Lufkin, TX (US); David W. Doyle, Groveton, TX (US); Martin E. Morales, Lufkin, TX (US); Brady D. Romano, Lufkin, TX (US)

(73) Assignee: Lufkin Industries, Inc., Lufkin, TX (US)

( * ) Notice: Subject to any disclaimer, the term of this patent is extended or adjusted under 35 U.S.C. 154(b) by 194 days.

(21) Appl. No.: 12/853,211

(22) Filed: Aug. 9, 2010

(65) Prior Publication Data

US 2012/0031208 A1 Feb. 9, 2012

(51) Int. Cl.
*F04B 47/02* (2006.01)
*F16H 21/32* (2006.01)

(52) U.S. Cl. ..... 74/41; 74/44; 166/68; 166/72; 166/75.11; 166/105.2

(58) Field of Classification Search ..... 74/41, 44, 74/99 R, 103, 108; 166/68, 72, 75.11, 105.2
See application file for complete search history.

(56) References Cited

U.S. PATENT DOCUMENTS 3,621,723 A * 11/1971 Miller ..... 74/41
4,520,683 A * 6/1985 Haverstock et al. ..... 74/41
4,603,592 A 8/1986 Siebold et al.
4,686,862 A * 8/1987 Mair et al. ..... 74/44
5,105,671 A 4/1992 Slater
6,112,607 A * 9/2000 Pauls ..... 74/44
7,048,049 B2 5/2006 Zupanick
7,090,009 B2 8/2006 Zupanick
7,406,887 B2 8/2008 Jensen

OTHER PUBLICATIONS

China-OGPE: "Bend Walking Beam Pumping Unit" photograph printed Jun. 29, 2010 http://www.china-ogpc.com/pimage/117/image/Bend_Walking_Beam_Pumping_Units_Product117.jpg.

* cited by examiner

*Primary Examiner* — Isam Alsomiri
*Assistant Examiner* — Valentin Craciun
(74) *Attorney, Agent, or Firm* — Sutton McAughan Deaver PLLC

(57) ABSTRACT

A method and pumping unit for use with an inclined wellhead. Proper address of the wellhead is accomplished through incorporation of an elbow-shaped walking beam. The forward section of the walking beam is fabricated such that its longitudinal axis is angled to address the inclination of the wellhead. The rearward section of the walking beam and the four-bar linkage system remains unchanged relative to a prior art pump jack intended for vertical wells. This modification is a simple and effective means of addressing an angled wellhead while preserving the well-known operating characteristics of a prior art pumping unit. Torque factors, polished rod position, speed, acceleration, stroke length, and effective counterbalance remain unchanged.

16 Claims, 5 Drawing Sheets

BEAM PUMPING UNIT FOR INCLINED WELLHEAD

BACKGROUND OF THE INVENTION

1. Field of the Invention

This invention relates generally to oilfield equipment, and in particular to surface-mounted reciprocating-beam sucker rod pumping units, commonly referred to as pump jacks. More particularly still, the invention relates to pump jacks for producing wells having inclined wellheads.

2. Background Art

Hydrocarbons are often produced from well bores by reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

FIG. 1 shows a class 1 walking beam pump jack (10) of prior art. The pump jack (10) is driven by a prime mover (12), typically an electric motor or internal combustion engine. The rotational power output from the prime mover (12) is typically transmitted by a belt or chain (14) to a gearbox (16). The gearbox (16) provides low-speed high-torque rotation of a crankshaft (22). Each end of the crankshaft (22) (only one is visible in FIG. 1) carries a crank arm (20) and a counterbalance weight (18). The reducer gearbox (16) sits atop a pedestal (17), which provides clearance for the crank arms (20) and counterweights (18) to rotate. The gearbox pedestal (17) is mounted atop a base (11). The base (11) also supports a samson post (13). The top of the samson post (13) acts as a fulcrum that pivotally supports a walking beam (24) via a saddle bearing assembly (15), commonly referred to as a center bearing assembly.

Each crank arm (20) is pivotally connected to a pitman arm (26) by a crank pin bearing assembly (19). The two pitman arms (26) are connected to an equalizer bar (27), and the equalizer bar (27) is pivotally connected to the rear end of the walking beam (24) by an equalizer bearing assembly (25). A horse head (28) with an arcuate forward face (29) is mounted to the forward end of the walking beam (24). The face (29) of the horse head (28) includes one or more tracks or grooves for carrying a flexible wire rope bridle (30). At its lower end, the bridle (30) terminates with a carrier bar (31), upon which a polished rod (32) is suspended. The polished rod (32) extends through a packing gland or stuffing box (34) at the wellhead (9). A rod string (36) of sucker rods hangs from the polished rod (32) within a tubing string (38) located within the well casing (40). The rod string is connected to the plunger of a subsurface pump (not illustrated). In a reciprocating cycle of the pump jack (10), well fluids are lifted within the tubing string (38) during the rod string (36) upstroke.

A walking beam pump jack operates, in essence, as a simple kinematic four-bar linkage mechanism, in which each of four rigid links is pivotally connected to two other of the four links to form a closed polygon. In a four-bar linkage mechanism, one link is typically fixed, with the result that a known position of only one other body is determinative of all other positions in the mechanism. The fixed link is also known as the ground link. The two links connected to the ground link are referred to as grounded links, and the remaining link not directly connected to the fixed ground link is referred to as the coupler link. Four-bar linkages are well known in mechanical engineering disciplines and are used to create a wide variety of motions with just a few simple parts.

Referring to FIG. 1, a four-bar linkage is embodied in the design of the pump jack (10) as follows: A fixed link (Link K) extends from the centerline of the crankshaft (12) to the centerline of the center hearing (15). Link K is defined by a grounded frame formed of interconnected rigid bodies including the samson post (13), the base (11), the gearbox pedestal (17), and the reducer gearbox (16). The first grounded link (Link R) is defined by the crank arms (20), and the second grounded link (Link C) is defined by the rear portion of the walking beam (24) extending from the centerline of the center bearing (15) to the centerline of the equalizer bearing (25). The pitmans (26) and the equalizer (27) together define the coupler link (Link P). This four-bar linkage is dimensioned so as to convert rotational motion of Link R into pivotal oscillation of Link C via the coupler Link P and the fixed Link K. That is, the crank arms (20) seesaw the walking beam (24) about the center bearing (15) atop the samson post (13) via the pitman arms (26) and equalizer (27).

Substantially all of the operating characteristics of a pump jack are determined by the dimensions of its four-bar linkage. For example, the torque factor relationship, polished rod position, stroke length, and counterbalance phase angle are dependent on the four-bar linkage dimensions. Torque factors and counterbalance phase angle are important parameters used to define the load carrying capacity of the pump jack. The varying interaction of these two terms with polished rod position is used to define permissible polished rod load envelope curves that are compared with measured dynamometer load data to verify that the reducer gearbox is operating within the designed torque loading.

The determination of pump jack operating characteristics is greatly simplified by the American Petroleum Institute ("API") Specification 11E ("Specification for Pumping Units"). API Specification 11E includes derived operational parameters as a function of the geometry of a pumping unit's four-bar linkage, expressed in terms of standardized geometry designations. Accordingly, pump jacks are commonly specified in terms of the API geometry designations, and nearly all pump jack manufacturers provide these API geometry dimensions.

FIGS. 2A and 2B illustrate the geometry designations promulgated by API for class 1 lever and class 3 lever pump jacks, respectively. Dimension "A" is the distance from the center of the saddle bearing to the centerline of the polished rod. Dimension "C" is the distance from the center of the saddle bearing to the center of the equalizer bearing. Dimension "P" is the effective length of the pitman arm as measured from the center of the equalizer bearing to the center of the crank pin bearing. Dimension "R" is the distance from the centerline of the crankshaft to the center of the crank pin bearing. Dimension "H" is the height from the center of the saddle bearing to the bottom of the pump jack base. Dimension "I" is the horizontal distance from the center of the saddle bearing to the centerline of the crankshaft. Dimension "G" is the height from the centerline of the crankshaft to the bottom of the pump jack base. Finally, dimension "K" (FIG. 1) is the distance from the centerline of the crankshaft to the center of the saddle bearing. Dimension "K" may be computed as:

$$K=\sqrt{(H-G)^2+I^2} \quad \text{(Equation 1).}$$

Pump jacks, like pump jack (10) of FIG. 1, are typically designed to operate in conjunction with a vertically aligned wellhead (9). However, an increasingly common practice in drilling and production is for the well bore to be inclined at some non-vertical angle so that the well bore penetrates the fluid producing strata along a lengthened path, thus providing the well bore with greater exposure to the producing formation. Directional drilling allows wells to be completed down hole at angles up to and including 90 degrees from vertical.

Depending on the well depth, it may be necessary that the wellhead is also inclined relative to the vertical axis. Such is often the case in shallow wells with near horizontal downhole completion angle or when surface topology prohibits drilling the well from directly above the producing formation. The range of surface inclination typically varies between 0 and 45 degrees from vertical.

Non-vertical wellheads present problems for traditional surface-deployed sucker rod pumping units, because, from both a polished rod load and counterbalance (gravitational) alignment standpoint, pump jack design is based upon a fundamental assumption of vertical operation. This assumption has greatly influenced placement and orientation of structural members, working angles of articulation for the walking beam and horse head, and the phase angle of the crank-mounted counterbalance.

Referring to FIG. 3, U.S. Pat. No. 4,603,592, issued to Seibold et al. ("Seibold"), discloses one potential means of addressing an inclined wellhead with a modified pumping unit (10') of the class 1 lever type. Seibold teaches adjustably lengthening the pitman arms (26'), tilting the samson post (13'), and enlarging the horse head (28') so that the pumping unit (10') can address wellheads (9') of various inclinations. The effective length of the pitman arm (Link P') and the rear span (Link C') of the walking beam are increased to produce the desired angle bias. That is, Seibold approaches the problem of wellhead inclination by altering the four-bar linkage geometry so that the polished rod (32) aligns with the inclined wellhead (9').

However, because the four-bar linkage is altered, these modifications have a significant effect on the operating characteristics of the pumping unit (10'). Modifications to the pumping unit four-bar linkage generally raise or lower the allowable polished rod load, change the shape of the permissible load envelope, alter the length of the pumping stroke, and induce a phase angle shift in the counterbalance. The polished rod speed and acceleration profiles are also sometimes substantially altered by these modifications.

Moreover, many downstream well analysis programs, diagnostic algorithms, rod pump controllers, and application tools involved in rod pump operation incorporate assumptions based upon standard four-bar linkage (K-R-P-C) usage into their calculations. While it is possible to predict the consequences of a modified linkage (K-R-P'-C') and make adjustments as per Seibold's recommendations, the end user of the equipment is burdened with a more complex scenario with regard to proper application of the equipment.

Additionally, the prior art Seibold pump jack of FIG. 3—with elongated pitman arms walking beam and horse head likely requires more steel than an ordinary pump jack. It is desirable, therefore, to have a pump jack suitable for pumping at inclined wellheads that employs a standard four-bar linkage arrangement.

3. Identification of Objects of the Invention

A primary object of the invention is to provide a method and beam pump apparatus arranged for pumping wells having inclined wellheads in which the four-bar linkage geometry of the pumping unit remains unchanged relative to the standard pumping unit geometry.

Another object of the invention is to provide a method and beam pump apparatus for properly addressing an angled wellhead while leaving the operational characteristics of the pumping unit, the allowable loading envelope, and the motion profile the same as a vertically aligned pumping unit of the same linkage geometry.

Another object of the invention is to provide a method and beam pump apparatus having a modified forward walking beam arranged for pumping wells having inclined wellheads in which torque factors associated with the pumping unit's four-bar linkage are not affected by the modified walking beam.

Another object of the invention is to provide a method and beam pump apparatus for pumping wells having inclined wellheads in which well load is converted to crankshaft torque throughout the pumping cycle at the same rate as with a standard pumping unit design.

Another object of the invention is to provide a method and beam pump apparatus for pumping wells having inclined wellheads in which the polished rod location, speed and acceleration profiles are essentially the same as with the standard vertically aligned pumping unit design.

Another object of the invention is to provide a method and beam pump apparatus having a modified forward walking beam arranged for pumping wells having inclined wellheads in which counterbalance is not affected by the modification and no phase angle mismatch is introduced between the counterbalance torque and well torque curves.

SUMMARY OF THE INVENTION

The objects described above and other advantages and features of the invention are incorporated in a method and apparatus that provides a modified pumping unit for operating in conjunction with a wellhead inclined relative to the vertical. Proper address of the angled wellhead is accomplished through incorporation of a non-linear, or bent, walking beam. The forward section of the walking beam is fabricated such that its longitudinal axis is angled to address the inclination of the wellhead. Specifically, the angled walking beam is shaped such that the bisector of the horse head swept arc, defined by the travel of the horse head during pump operation, is ideally normal to the wellhead axis. The rearward section of the walking beam, from the saddle bearing to the equalizer hearing, and the four-bar linkage system embodied by the pump jack, remains unchanged relative to a prior art pump jack intended for vertical wells.

The samson post is inclined as necessary to maintain proper wellhead clearance and to maintain predominantly compressive reaction forces in the individual samson post members.

Depending on the degree of inclination of the wellhead, the forward samson post members may even be vertical or be inclined forward.

These modification are a simple and effective means of addressing an angled wellhead while preserving the well-known operating characteristics of a prior art pumping unit. Torque factors, polished rod position, speed, acceleration, stroke length, and effective counterbalance remain unchanged.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 4:
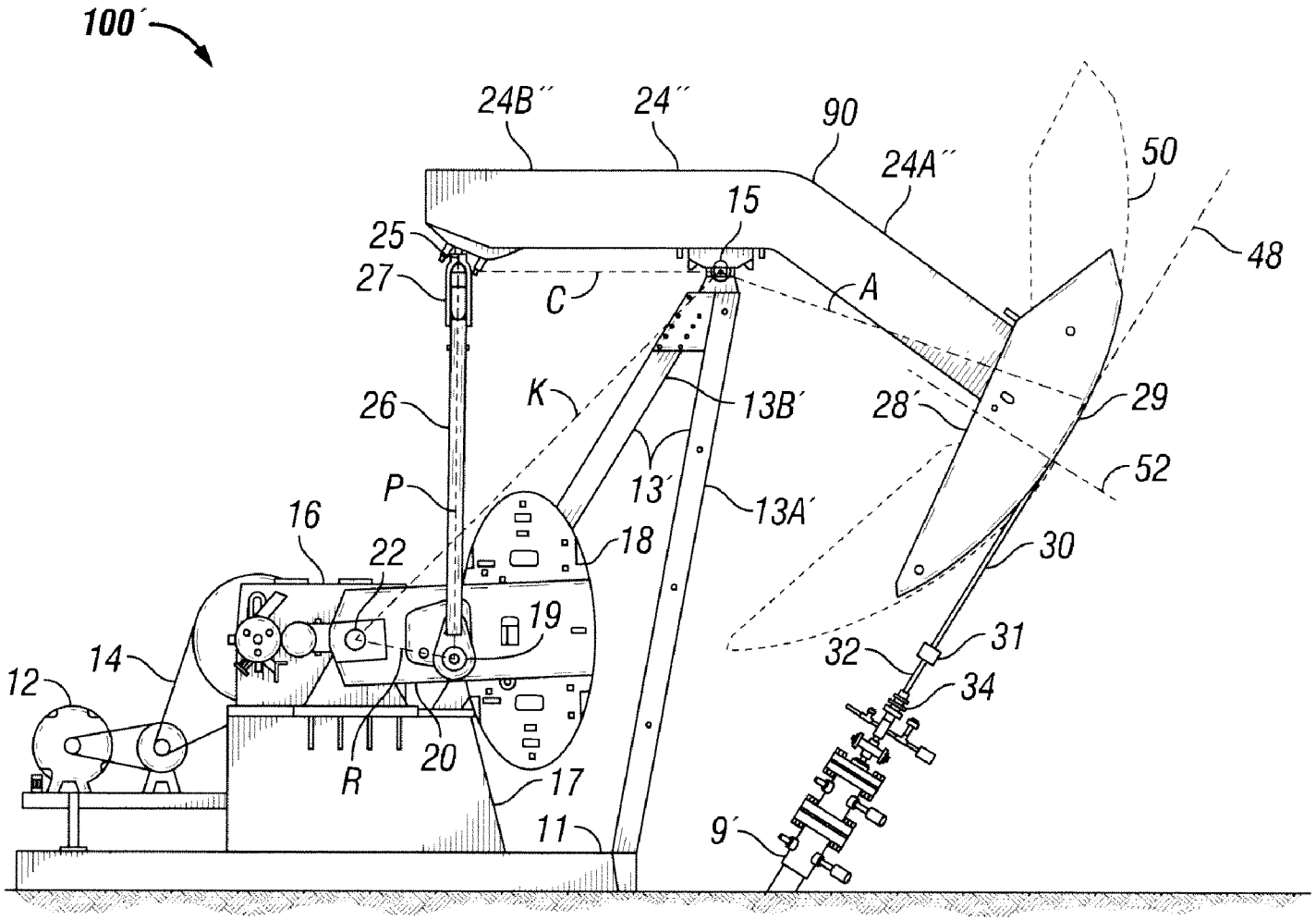
FIG. 4 is a side elevation view of a class 1 lever type beam pumping unit according to a preferred embodiment of the invention, showing an elbow-shaped walking beam for addressing an inclined wellhead without modifying the standard four-bar linkage system of the pump jack of FIG. 1.

Referring to FIG. 4, a preferred embodiment of the invention is a class 1 lever type pumping unit 100. Like prior art pump jack 10 of FIG. 1, pump jack 100 includes a prime mover 12, typically an electric motor or internal combustion engine. The rotational power output from prime mover 12 is typically transmitted by a belt or chain 14 to a gearbox 16. Gearbox 16 provides low-speed high-torque rotation to a crankshaft 22. Each end of crankshaft 22 (only one is visible in FIG. 4) carries a crank arm 20 and a counterbalance weight 18. Reducer gearbox 16 sits atop a pedestal 17, which provides clearance for crank arms 20 and counterweights 18 to rotate. The gearbox pedestal 17 is mounted atop a base 11.

Base 11 supports a samson post 13'. The top of samson post 13' acts as a class 1 lever fulcrum that pivotally supports a walking beam 24" via a saddle bearing assembly 15 (commonly referred to as a center bearing assembly). Each crank arm 20 is pivotally connected to a pitman arm 26 by a crank pin bearing assembly 19. The two pitman arms 26 are connected to an equalizer bar 27, and equalizer bar 27 is pivotally connected to the rear end of walking beam 24" by an equalizer bearing assembly 25. A horse head 28' with an arcuate forward face 29 is mounted to the forward end of the walking beam 24". The face 29 of horse head 28' includes one or more tracks or grooves for carrying a flexible wire rope bridle 30. At its lower end, bridle 30 terminates with a carrier bar 31, upon which a polished rod 32 is suspended. Carrier bar 31 includes a clamping arrangement to retain polished rod 32 with limited relative linear movement. Polished rod 32 extends through a packing gland or stuffing box 34 at the wellhead 9'.

Walking beam 24" is elbow-shaped, which provides for proper address of angled wellhead 9'. The elbow shape is formed by a bend or elbow section 90 that defines forward and rearward sections 24A", 24B", respectively. Bend 90 is located forward of the centerline of center bearing 15. The forward section 24A" of walking beam 24" is fabricated such that its longitudinal axis is angled to address the inclination of the wellhead 9'. The radius A from the centerline of center bearing 15 to the arcuate face 29 of horse head 28' is tangent to the inclined polished rod 32. Ideally, the angled shape of walking beam 24" is such that the bisector 52 of the horse head swept arc 50, defined by the travel of the horse head 28' during pump operation, is ideally normal to the wellhead axis 48.

Figure 1:
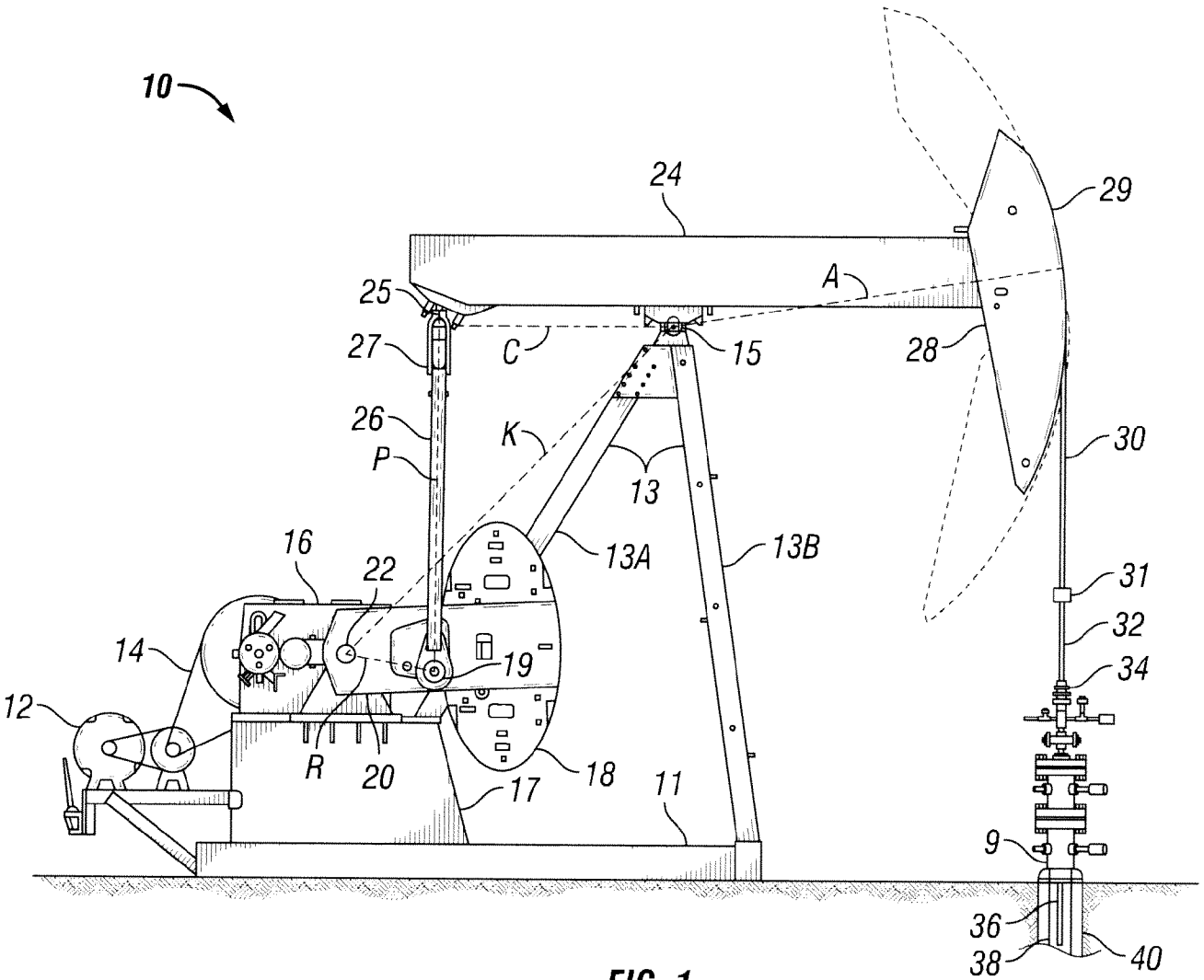
FIG. 1 (Prior Art)
FIG. 1 is a side elevation view of a class 1 lever type beam pumping unit of prior art having a standard four-bar linkage system embodied thereby.
Figure 2A:
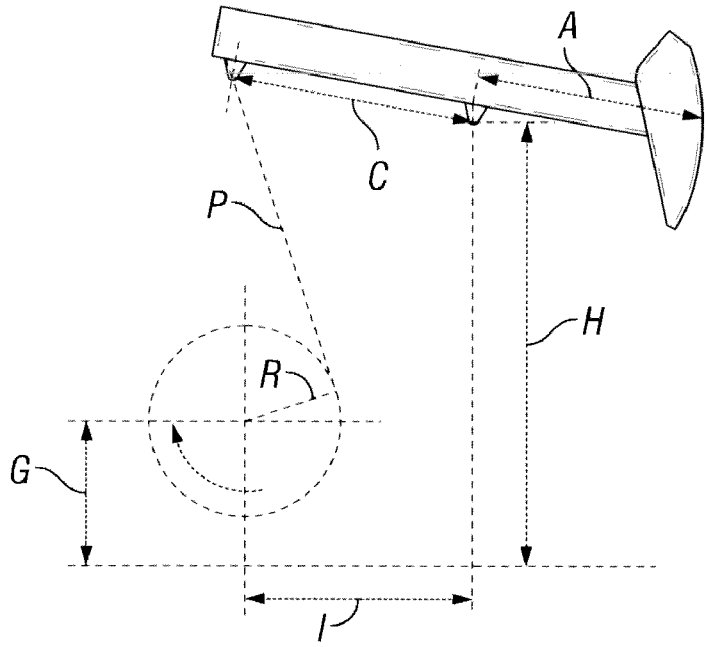
FIG. 2A (Prior Art)
FIG. 2A is a side elevation schematic of a class 1 lever type beam pumping unit of prior art, showing standardized API linkage geometry designations.
Figure 2B:
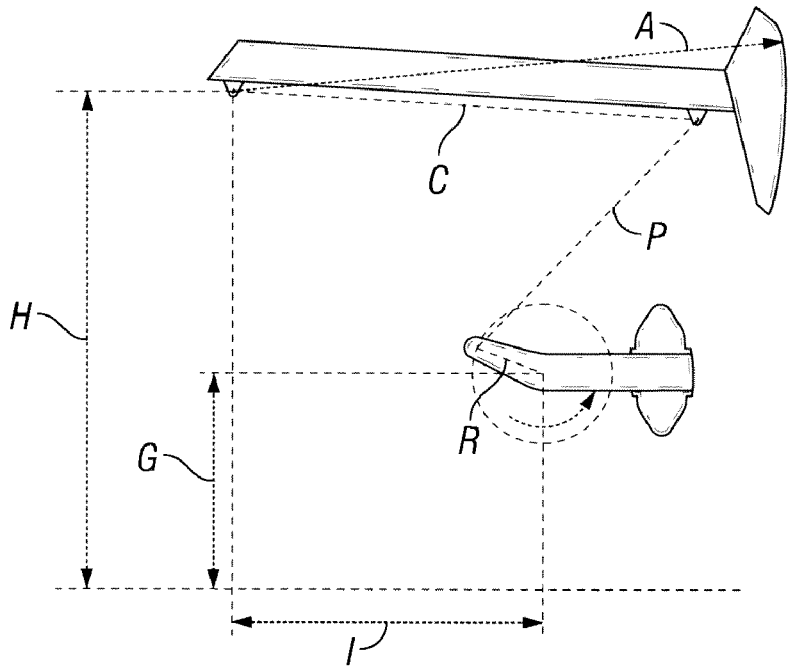
FIG. 2B (Prior Art)
FIG. 2B is a side elevation schematic of an ordinary class 3 lever type beam pumping unit of prior art, showing standardized API linkage geometry designations.

In a preferred embodiment, walking beam 24" is bent downwards, which allows pump jack 100 to be positioned close to wellhead 9' and allows a shorter bridle 30 and/or polished rod 32. However, if desired, walking beam 24" may be bent upwards (see, e.g., FIG. 5) to accommodate an inclined wellhead. The rearward section 24B" of walking beam 24" (in particular, rearward of the centerline of center bearing 15) and pitman arms 26 remain unchanged relative to a class 1 lever type pumping unit 10 (preferably an improved-geometry phased counterbalance model) of prior art intended for vertical wells (FIG. 1). Accordingly, the connected four-bar linkage system is unchanged relative to prior art pump jack 10. The non-linear bent walking beam 24" provides a simple and effective means of addressing angled wellhead 9' while preserving the operating characteristics of a prior art pumping unit 10 (FIG. 1). Torque factors, polished rod position, speed, acceleration, stroke length, and effective counterbalance are essentially unchanged relative to a standard vertical well pumping unit of the same four-bar geometry. And, because neither pitman arms 26 nor rear walking beam 24B" require elongation to accommodate the inclined wellhead angle, raw material is conserved.

Wellheads 9' of differing angles of inclination generally require fabrication of a bent walking beam 24" that closely matches the wellhead angle. Generally, operators know in advance the wellhead angle and arc able to include such information in the specification to the pumping unit manufacturer. However, an enlarged horse head 28' may be used with pump jack 100, as taught by Seibold, so that minor angle variances can be accommodated.

Figure 3:
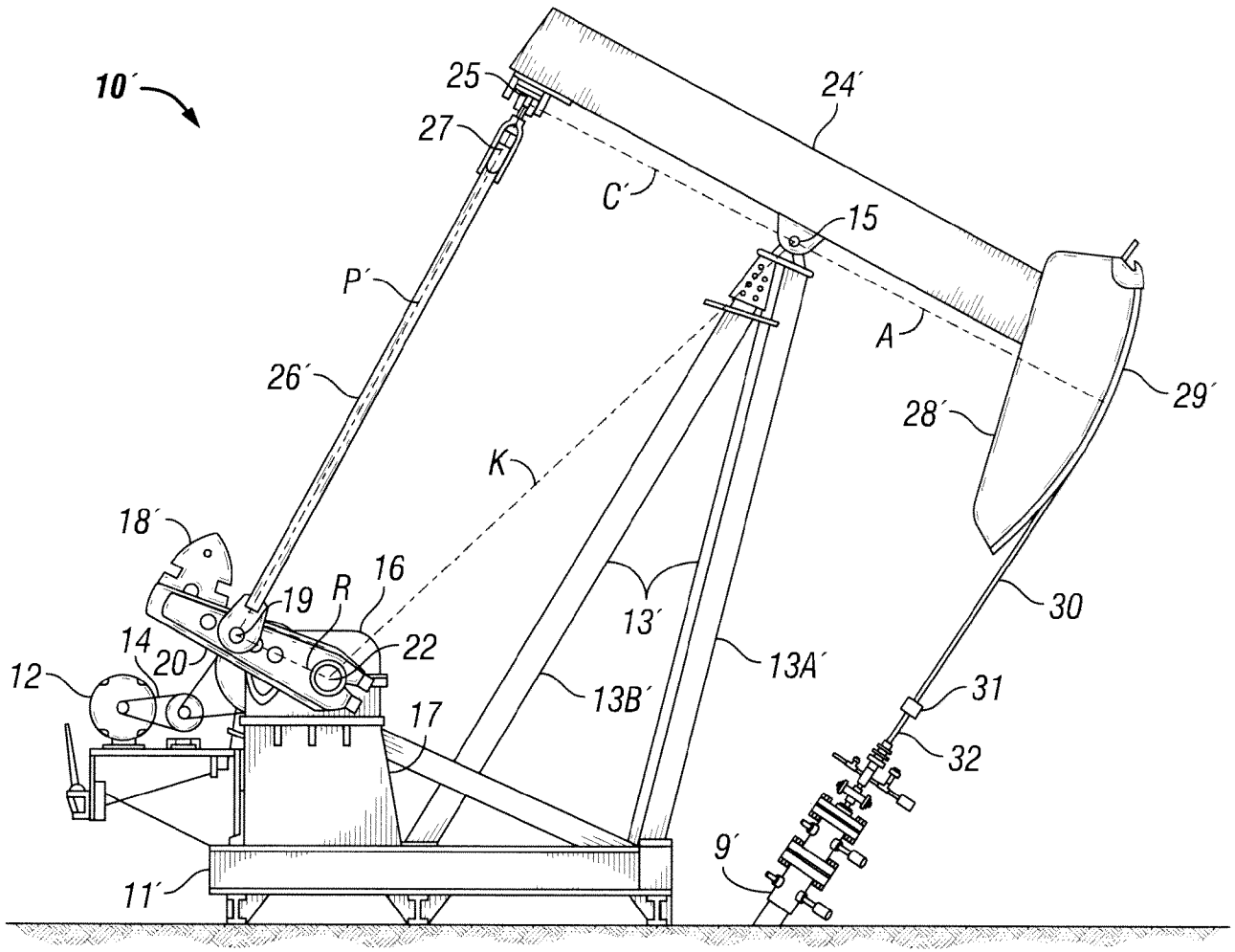
FIG. 3 (Prior Art)
FIG. 3 is a side elevation view of a beam pumping unit arranged for addressing inclined wellheads according to the prior art, showing a pump jack with a lengthened effective pitman arm, and thereby a modified four-bar linkage, as compared to an ordinary pump jack arranged for addressing vertical wellheads.

The positioning of the front samson post legs 13A in a typical class 1 type pumping unit 10 (FIG. 1) may interfere with inclined wellhead 9'. Moreover, as described by Seibold, the inclined polished rod (well) force may cause undesirable tension forces in a conventionally oriented samson post 13. Accordingly, similar to the samson post 13' of FIG. 3, the forward samson post members 13A in pump jack 100 may have an unusual inclination so that adequate wellhead clearance is maintained. For example, for wellheads having large inclinations, the forward samson post members 13A may be inclined forward (i.e., the feet are shifted rearward of the center bearing 15). The skewed samson post 13' also allows the direction of the resultant center bearing force to be directed between the front and rear samson post members 13A, 13B, respectively, ensuring that they are loaded in compression. U.S. Pat. No. 4,603,592, issued to Seibold et al. on Aug. 5, 1986 and entitled "Off-Vertical Pumping Unit," ("Seibold"), which describes samson post 13', is incorporated herein by reference.

Figure 5:
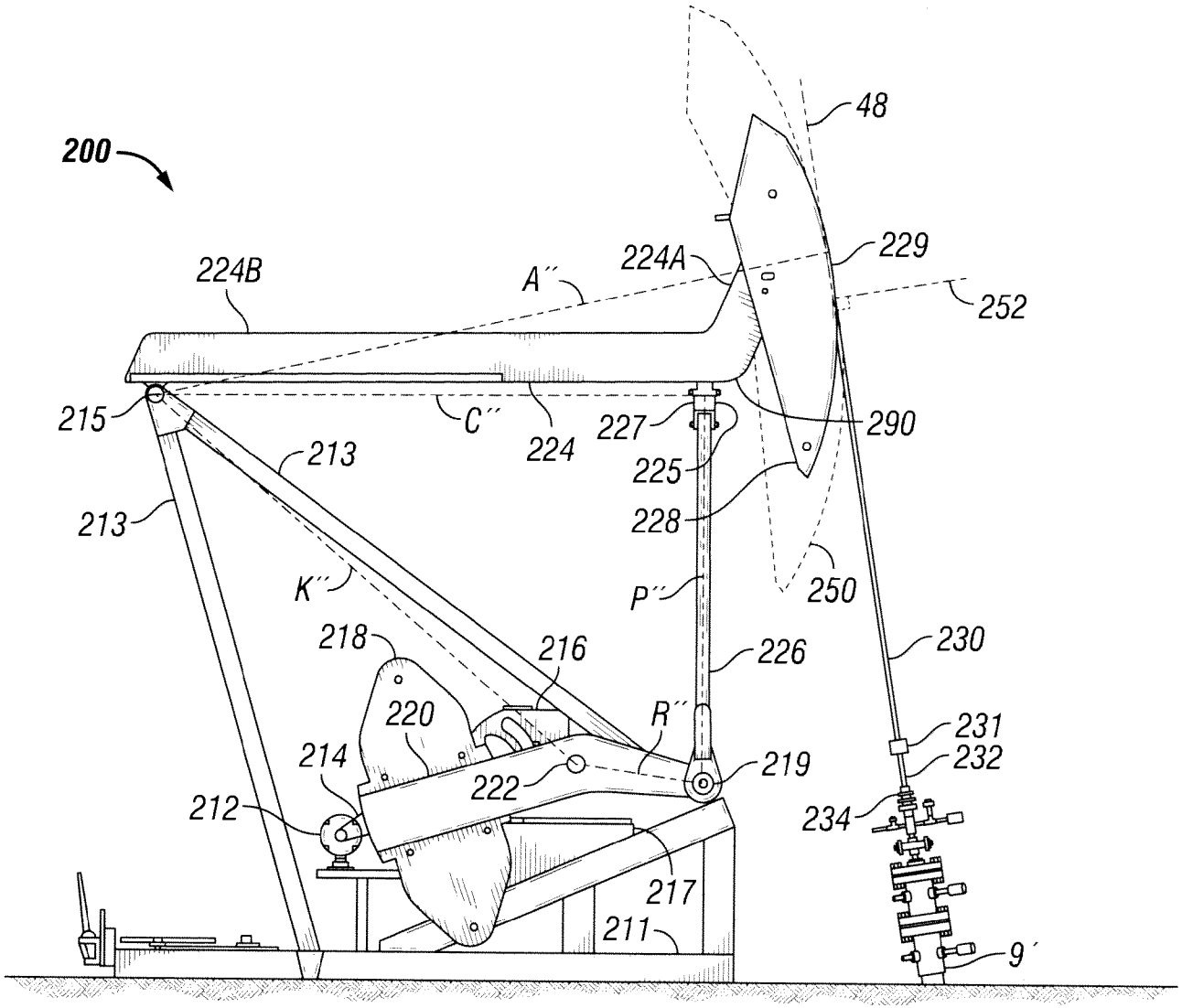
FIG. 5 is a side elevation view of a class 3 lever type beam pumping unit according to an alternate embodiment of the invention, showing an elbow-shaped walking beam for addressing an inclined wellhead without modifying the standard four-bar linkage system of an ordinary class 3 pump jack of prior art.

FIG. 5 shows an alternate embodiment of the invention—a class 3 lever type pumping unit 200. Pump jack 200 includes a prime mover 212, typically an electric motor or internal combustion engine. The rotational power output from prime mover 212 is typically transmitted by a belt or chain 214 to a gearbox 216. Gearbox 216 provides low-speed high-torque rotation to a crankshaft 222. Each end of crankshaft 222 (only one is visible in FIG. 5) carries a crank arm 220 and a counterbalance weight 218. Reducer gearbox 216 sits atop a pedestal 217, which provides clearance for crank arms 220 and counterweights 218 to rotate. The gearbox pedestal 217 is mounted atop a base 211.

Base 211 supports a samson post 213. The top of samson post 213 acts as a class 3 lever fulcrum that pivotally supports a walking beam 224 via a saddle bearing assembly 215 (commonly referred to as a samson post bearing assembly). Each crank arm 220 is pivotally connected to a pitman arm 226 by a crank pin bearing assembly 219. The two pitman arms 226 are connected to an equalizer bar 227, and equalizer bar 227 is pivotally connected near the forward end of walking beam 224 by an equalizer bearing assembly 225. A horse head 228 with an arcuate forward face 229 is mounted to the forward end of the walking beam 224. The face 229 of horse head 228 includes one or more tracks or grooves for carrying a flexible wire rope bridle 230. At its lower end, bridle 230 terminates with a carrier bar 231, upon which a polished rod 232 is suspended. Polished rod 232 extends through a packing gland or stuffing box 234 at the wellhead 9'.

Walking beam 224 is elbow-shaped, which provides for proper address of angled wellhead 9'. The elbow shape is formed by a bend or elbow section 290 that defines forward and rearward sections 224A, 224B, respectively. Bend 290 is located forward of the centerline of equalizer bearing 225. The forward section 224A of walking beam 224 is fabricated such that its longitudinal axis is angled to address the inclination of the wellhead 9'. The radius A from the centerline of samson post bearing 215 to the arcuate face 229 of horse head 228 is tangent to the inclined polished rod 232. Ideally, the angled shape of walking beam 224 is such that the bisector 252 of the horse head swept arc 250, defined by the travel of the horse head 228 during pump operation, is ideally normal to the wellhead axis 48.

As shown in FIG. 5, walking beam 224 may be bent upwards. Walking beam 224 may also be bent downwards (see, e.g., FIG. 4). The rearward section 224B (in particular, rearward of the centerline of equalizer bearing 225) of walking beam 224, the pitman arms 226, and the four-bar linkage (K"-R"-P"-C") remain unchanged relative to a prior art class 3 lever type pumping unit. The non-linear bent walking beam 224 provides a simple and effective means of addressing angled wellhead 9' while preserving the operating characteristics of a prior art pumping class 3 lever type pump jack.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art.

What is claimed is:

1. In a surface pumping unit (10) for reciprocating a downhole pump located in a well having a substantially vertical wellhead (9), the pumping unit (10) including a walking beam (24) pivotally mounted and supported by a saddle bearing (15) atop a frame (13, 11, 17), said walking beam (24) pivotally coupled to a pitman arm (26) by an equalizer bearing (25), said pitman arm (26) pivotally coupled to a crank arm (20) by a crank pin bearing (19), said crank arm connected to a crankshaft (22) for rotation about a centerline of said crankshaft (22), said crankshaft (22) being rotatively mounted to said frame, whereby said crank arm (20), said pitman arm (26), said walking beam and said frame collectively define a four-bar linkage mechanism operable to cause said walking beam (24) to seesaw about said saddle bearing (15) upon rotation of crank arm (20), said four-bar linkage mechanism characterized by a predetermined linkage geometry defined by distances between a centerline of said saddle bearing (15), a centerline of said equalizer bearing (25), a centerline of said crank pin bearing (19) and the centerline of said crankshaft (22), a front end of said walking beam terminating with an arcuate horse head (28) that is coupled to said downhole pump by a rod string (36) that passes through said wellhead (9), the improvement comprising:

a bend (90) formed in said walking beam (24", 224) forward of said fulcrum point;

whereby said pumping unit (100, 200) is arranged to permit pumping at a wellhead (9') characterized by a wellhead axis (48) that is inclined from the vertical while maintaining said predetermined linkage geometry.

2. The surface pumping unit (100, 200) of claim 1 wherein:

said seesawing of said walking beam (24", 224) defines a swept arc (50, 250) of said horse head (28', 228); and said bend (90, 290) inclines said horse head (28', 228) so that a bisector (52, 252) of said swept arc (50, 250) is perpendicular to said wellhead axis (48).

3. The surface pumping unit (100, 200) of claim 2 wherein:

said bend (90, 290) inclines said horse head (28') downward toward said frame.

4. The surface pumping unit (100, 200) of claim 1 wherein:

said bend (90, 290) is disposed forward of said equalizer bearing (25).

5. The surface pumping unit (100) of claim 1 wherein:

said frame includes a samson post (13') having a rear member (13B') and a forward member (13A'); and an upper end of said forward member is disposed forward of a lower end of said forward member.

6. In a surface pumping unit (10) for reciprocating a downhole pump located in a well, the pumping unit (10) including a base (11), a walking beam (24) pivotally mounted at a fulcrum point (15) and coupled to a prime mover (12) so as to cause said walking beam to pivotally oscillate about said fulcrum point such that the medial position of said walking beam is substantially parallel to said base, and an arcuate horse head (28') that is connected to a front end of said walking beam and coupled to said downhole pump by a rod string (36) that passes through a wellhead (9), the improvement comprising:

a bend (90, 290) formed in said walking beam (24", 224) forward of said fulcrum point (15), said bend defining a rearward portion (24B", 224B) of said walking beam that remains characterized by said substantially parallel medial position and a forward portion (24A", 224A) of said walking beam that is characterized by a medial position that is substantially inclined with respect to said base (11);

whereby said pumping unit (100, 200) is arranged to permit pumping at a wellhead (9') characterized by a wellhead axis (48) that is inclined from the vertical.

7. The surface pumping unit (100, 200) of claim 6 wherein:

said oscillation of said walking beam (24", 224) defines a swept arc (50, 250) of said horse head (28', 228); and said bend (90, 290) inclines said horse head (28', 228) so that a bisector (52, 252) of said swept arc (50, 250) is perpendicular to said wellhead axis (48).

8. The surface pumping unit (100, 200) of claim 6 wherein:

said forward portion (24A", 224A) is inclined downward toward said base (11, 211) with respect to said rearward portion (24B", 224B).

9. The surface pumping unit (100, 200) of claim 6 further comprising:

a saddle bearing (15, 215) defining said fulcrum point.

10. The surface pumping unit (100) of claim 9 further comprising:

a samson post (13') supporting said saddle bearing (15), said a samson post having a rear member (13B') and a forward member (13A'), an upper end of said forward member being disposed forward of a lower end of said forward member.

11. The surface pumping unit (100) of claim 6 wherein:

said pumping unit (100) defines a class 1 lever.

12. In a surface pumping unit (10) for reciprocating a downhole pump located in a well, the pumping unit (10) including a walking beam (24) pivotally mounted at a fulcrum point and coupled to a prime mover (12) so as to cause said walking beam to seesaw about said fulcrum point, a front end of said walking beam terminating with an arcuate horse head that is coupled to said downhole pump by a rod string (36) that passes through a wellhead (9), the improvement comprising:

a bend (90, 290) formed in said walking beam (24", 224) forward of said fulcrum point;

whereby said pumping unit (100, 200) is arranged to permit pumping at a wellhead (9') inclined from the vertical.

13. The surface pumping unit (100, 200) of claim 12 wherein:

operation of said pumping unit (100, 200) defines a swept arc (50, 250) of said horse head (28', 228); and said bend (90, 290) inclines said horse head (28', 228) so that a bisector (52, 252) of said swept arc (50, 250) is perpendicular to an axis (48) of said wellhead (9').

14. The surface pumping unit (100, 200) of claim 12 wherein:

said forward portion (24A", 224A) is inclined downward toward said base (11) with respect to said rearward portion (24B", 224B).

15. The surface pumping unit (100) of claim 12 further comprising:

a center bearing (15) defining said fulcrum point; and a samson post (13') supporting said saddle bearing (15), said a samson post having a rear member (13B') and a forward member (13A'), an upper end of said forward member being disposed forward of a lower end of said forward member.

16. The surface pumping unit (100) of claim 12 wherein:

said pumping unit (100) defines a class 1 lever.

* * * * *